US005807079A

United States Patent [19]

Wilson

[11] Patent Number: 5,807,079

[45] **Date of Patent: *Sep. 15, 1998**

[54] PUMP CLAMP ADAPTER

[76] Inventor: Robert G. Wilson, 234 Robinson Dr., Oak Harbor, Ohio 43449

[ * ] Notice: The terminal 15 months of this patent has been disclaimed.

[21] Appl. No.: 192,419

[22] Filed: Feb. 4, 1994

[51] Int. Cl.[6] ..... F04B 17/00

[52] U.S. Cl. ..... 417/360; 285/415

[58] Field of Search ..... 417/437, 360, 417/572; 403/310, 312, 335, 337; 285/414, 415

[56] References Cited

U.S. PATENT DOCUMENTS

| | | | |
|---|---|---|---|
| 2,800,912 | 7/1957 | McCamish | 285/414 |
| 4,265,839 | 5/1981 | Baus | 417/360 |
| 4,747,723 | 5/1988 | Hasley | 403/310 |
| 5,156,536 | 10/1992 | Wilson | 417/572 |

FOREIGN PATENT DOCUMENTS

| | | | |
|---|---|---|---|
| 58318 | 1/1975 | Australia | 285/414 |

*Primary Examiner*—Charles Freay

*Attorney, Agent, or Firm*—Jerry W. Semer

[57] ABSTRACT

This pump clamp adapter allow an individual who has a can or a pail that has a spout with a annular rim around the opening to be used with a safety pump. The adapter is created out of two semi-circular disk. Around the outer edge of the semi-circular disk on its bottom is a ridge. When the two semi-circular disks are placed together to form a cylindrical disk the ridge forms an annular recess underneath the disk. This annular recess fit over the annular rim adapter on the can. On the bottom of the ridge are three wedge shaped feet. These wedge shaped feet are designed to scratch through the paint on the top of the can and make contact with the metal below said paint. A semi-circular's cut out is formed in the center of the straight side of the semi-circular's disk. When the two semi-circular's disks are placed together, the semi-circular's cut out will form a bore in the center of the cylindrical disk of sufficient size so that a pump can be placed through the bore. On the upper inside edge of this ridge on the straight portion of the semi-circular disk a shoulder is formed extending outward from the ridge. This shoulder is adapted such that when the ridges are tighten together the lower portion of the semi-circular disk without the shoulder will draw in further then the upper portion. Thus, causing the feet on the annular ridge to dig into the painted surface of the can.

18 Claims, 4 Drawing Sheets

PUMP CLAMP ADAPTER

FIELD OF THE INVENTION

This invention relates generally to the fields of clamps for attaching a pump to a liquid filled can or barrel for pumping the liquids from can or barrel and more particularly a clamp for attaching a safety pump to a can or barrel.

BACKGROUND OF THE INVENTION

Today many small businesses deal with small quantitys of flammable liquids. These flammable liquids are shipped to the small companies in cans or small barrels that contains larger quantities of liquid then the company can use at one time. Therefore, these flammable liquids usually have to be pumped out of the larger container into a smaller container. The pumping of these liquids into a small container is very hazardous. One of the hazards of pumping liquids out of a can or barrel is static electric buildup in the pumping action and this static electric could cause a spark igniting the flammable liquids. The inventor has addressed this problem before in U.S. Pat. No. 5,156,536 to Wilson issued on Oct. 20, 1992. The disclosure of this patent is hereby incorporated by reference. In this patent the inventor has designed a safety pump for pumping liquids safely from a reservoir container to a receptacle. The pump grounds not only itself but also the reservoir container and the receptacle container. This pump is designed to ground the reservoir container by being conductive and making conductive contact with a conductive reservoir container. The pump has a ground wire attached to it and thus the static electricity that builds up on the reservoir container flows to the pump and though the ground wire to the ground.

Inventor has found that one of the problems with this set up is that although most reservoir containers are made out of conductive metals, they are often painted and it is difficult to get contact with the metal. Therefore, one of the objectives of this invention is to create a clamp that will clamp a safety pump to a container from which flammable liquids are to be pumped such that the clamp will make conductive contact with the conductive receptacle. As stated above the main problem is usually that the container has been painted; therefore, the inventor has designed a clamp that will scratch the paint so as to make the conductive contact. Thus, it is objective of this invention to create a clamp that when being tighten to fasten the pump to the container, the clamp will scratch the paint of the container and make conductive contact with the metal of the container under the paint. The basic feature to achieve this goal is serration on the bottom of the clamp. When the clamp is tighten down to fasten the pump to the container its bottom surface which has the serration, scratches the paint on the surface of the can and forms a good conductive contact.

A further problem addressed by the inventor is how to attach a pump to a can with a annular rim around the opening as a can with a flex spout. The feature that enables the adapter to attach to a can with a flex spout is that the adapter is split and can easily fit over the rim of the flex spout.

SUMMARY OF THE INVENTION

This pump clamp adapter allows an individual who has a can or a pail that has a spout with a annular rim around the opening on the can like Flex Spout a flexible spout attached to the can with a plastic adapter with an non conductive annular rim made by Rieke to be used with a safety pump to get the liquids from the can. The adapter is split, being created out of two semi-circular disk. Around the outer edge of the semi-circular disk on its bottom is a ridge. When the two semi-circular disks are placed together to form a cylindrical disk the ridge forms an annular recess underneath the disk. This annular recess is of a size sufficient to fit over the annular rim of the flex spout adapter on the can. On the bottom of the ridge are three wedge shaped feet. These wedge shaped feet are designed to scratch through the paint on the top of the can and make contact with the metal below said paint. A semi-circular's cut out is formed in the center of the straight side of the semi-circular's disk. When the two semi-circular's disks are placed together to form the circular disk the semi-circular's cut out will form a bore in the center of the cylindrical disk of sufficient size so that a pump can be placed through the bore. Along the entire length of the straight side with semi-circular cut out of the semi-circular's disk a ridge projects upward. On each of the straight portion of the ridge on each semi-circular's disk an opening is created. These openings are adapted so that a screw can be placed through the opening when both semi-circular's disk are placed together to form a circular disk and the screw can be tighten to hold the semi-circular disk together in the form of the circular disk. On the upper inside edge of this ridge on the straight portion of the semi-circular disk a shoulder is formed extending outward from the ridge. This shoulder is adapted such that when the ridges are tighten together the lower portion of the semi-circular disk without the shoulder will draw in further then the upper portion. Thus, causing the feet on the annular ridge to dig into the painted surface of the can. A threaded opening is placed in the ridge that runs along the straight side with the semi-circular cut outs of the semi-circular disks in the area in which the ridge is semi-circular. A screw is placed through this opening and screwed tightly against a pump placed through the bore to hold the pump in place.

DETAILED OF THE PREFERRED EMBODIMENT

Figure 1:
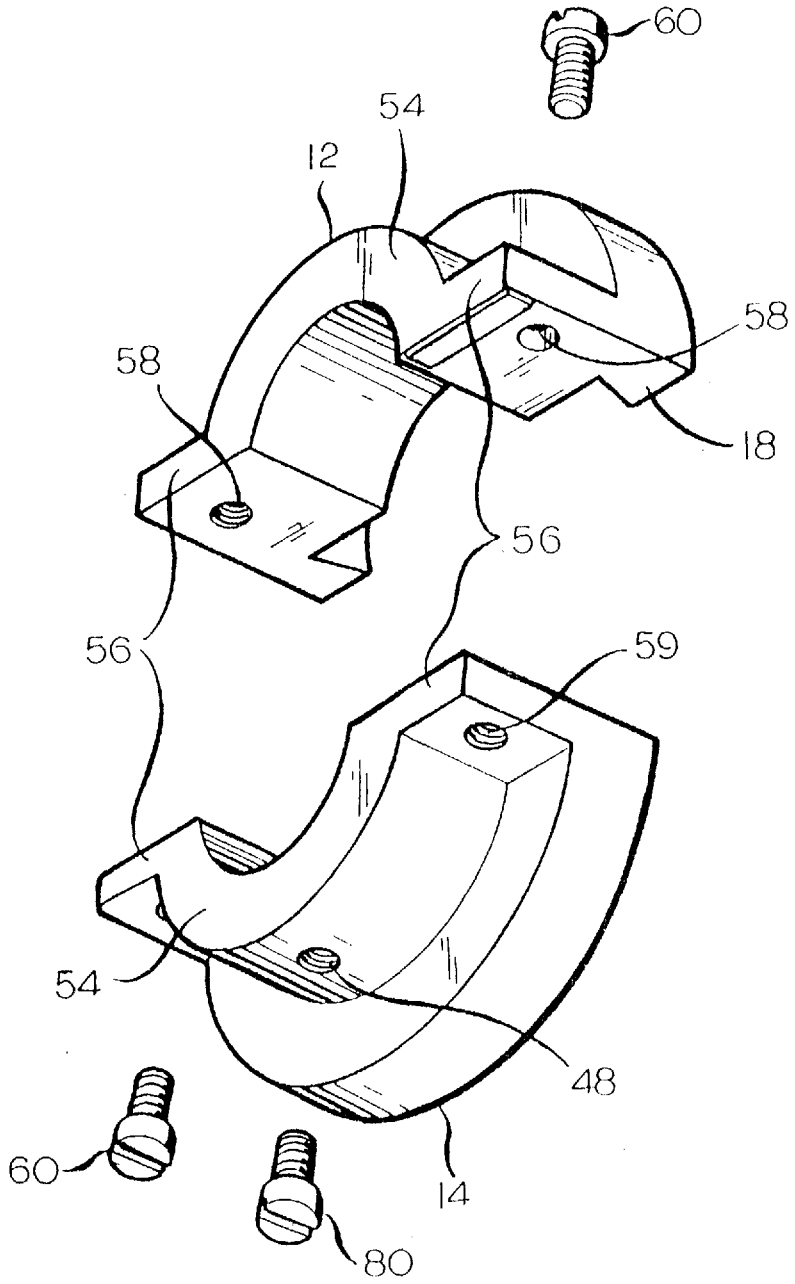
FIG. 1 is an exploded perspective view of the invention
Figure 4:
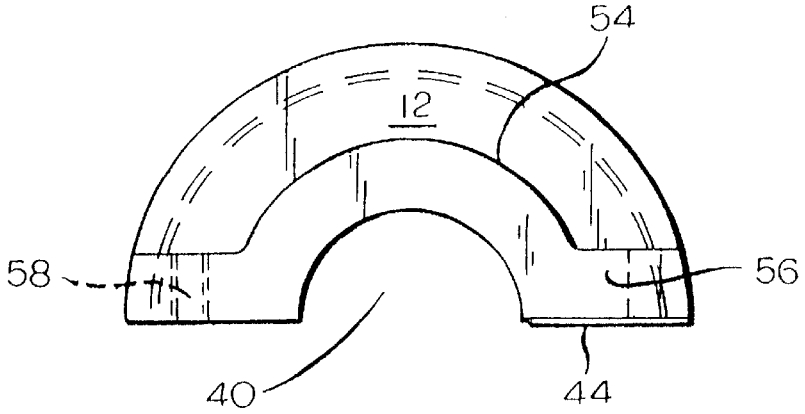
FIG. 4 is the top view of one semi-circular disk.
Figure 2:
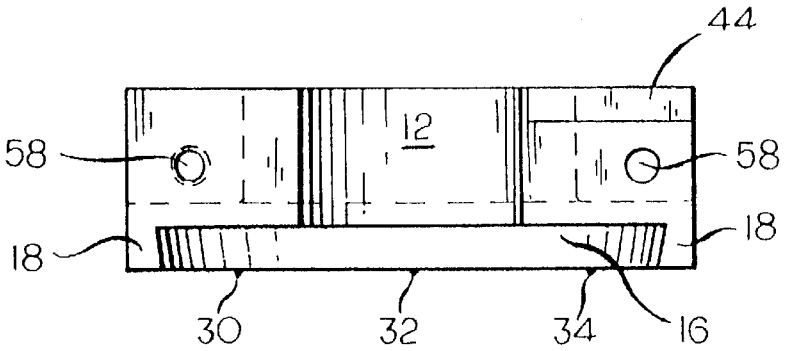
FIG. 2 is the front view of one semi-circular disk.
Figure 3:
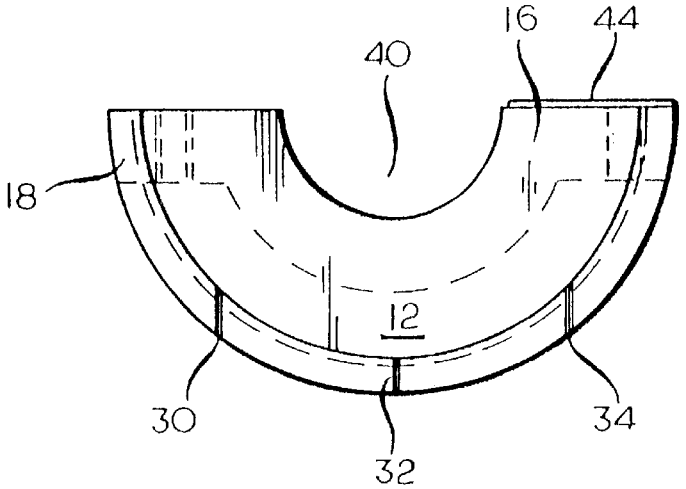
FIG. 3 is the bottom view of one semi-circular disk.
Figure 5:
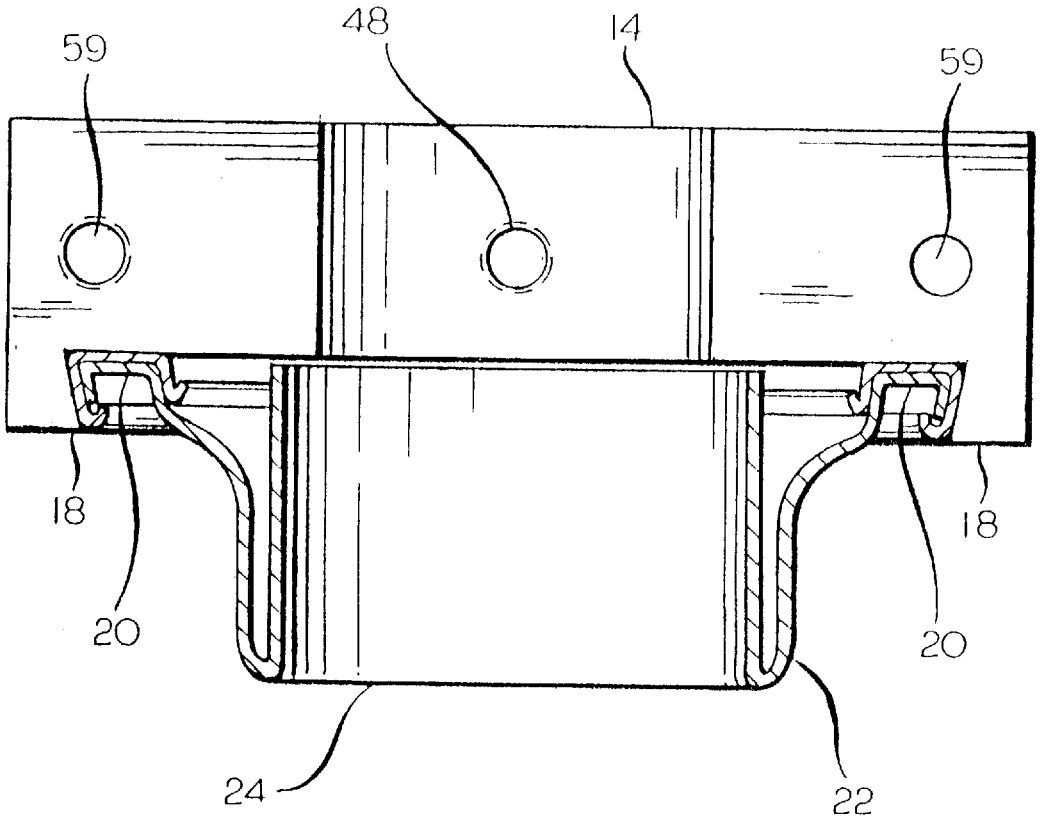
FIG. 5 is a cut away view of the invention on a can.
Figure 6:
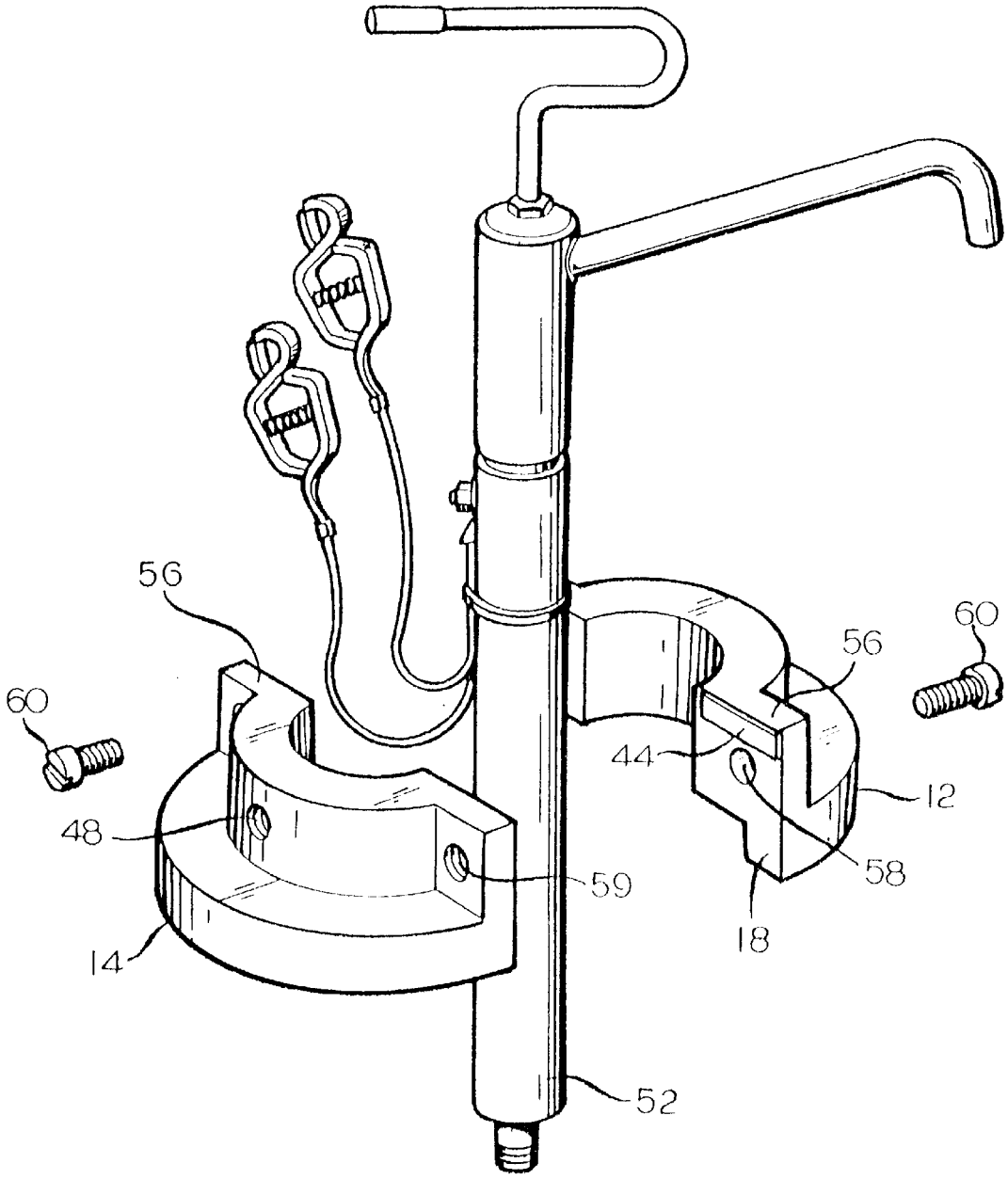
FIG. 6 is a perspective view of the invention around a safety pump.

The invention is a pump clamp adapter. This pump clamp adapter allows individuals who have a can or pail with a Flex Spout, a flexible spout attached to the can by a non conductive adapter with an annular rim around the opening on the can like a flex's spout made by the Rieke Company to use a safety pump such as the one described in the patent to Wilson U.S. Pat. No. 5,156,536 to get liquids from the can. FIG. 1 shows a perspective view of the adapter. The adapter is formed by two semi-circular disks 12 and 14. FIG. 3 shows the bottom view of either of the semi-circular disk 12 or 14. This view shows a ridge 18 extending downward from the bottom around the outer edge of the semi-circular disk 12 and 14. When both semi-circular disk 12 or 14 are placed together the ridge 18 forms an annular recess 16 underneath the disk as shown in FIG. 2. This annular recess 16 is of the size sufficient to fit over the annular rim 20 of the flex spout adapter 22 on the mouth of the can 24 as shown in FIG. 5. As shown in FIG. 2 and 3 in the preferred embodiment on the bottom of the ridge 18 there are three wedge shaped feet 30, 32 and 34. These wedge shaped feet 30, 32 and 34 are designed to scratch through the paint on the top of the can 24 and make contact with the metal below said paint. In the preferred embodiment there are three wedge shaped feet 30, 32 and 34 on the bottom of each of the semi-circular disks 12 and 14. However, the number of feet or their shape does not matter as long as the feet are able to scratch the surface of the paint on the can and provide electrical contact with the metal can. The object behind scratching the paint on the can 24 is to provide electrical conductance between the can 24 and the adapter. The adapter is made out of metal. However the adapter can be made out of any conductive material that could hold a pump in place. Screw 50 shown in FIG. 1 makes contact with the pump 52 and holds it in place. The screw is also made out of conductive material and thus, if the adapter is in contact with the metal can 24 then any static electricity that builds up on the can 24 will flow through the adapter through the metal screw 50 that is in contact with the pump 52 and down the pump's 52 grounding wires. Therefore by using this adapter and a safety pump containing grounding wires such as the one shown U.S. Pat. No. 5,156,536 to Wilson an individual can discharge the static buildup on the receptacle from which the individual is pumping and therefore lessen the chance of fire due to static buildup on the receptacle container. In the center of the inside edge of the semi-circular disk a semi-circular cut 40 out is formed as shown in FIG. 3. When the two disks are placed together these semi-circular cut outs will form a bore in the center of the device of sufficient size so that a pump 52 can be placed through the bore as shown in FIG. 3 and FIG. 5.

Also, along the entire length of the inner edge on the top of the semi-circular disk a ridge 54 projects upward as shown in FIGS. 1, 2, 3 and 4. On the straight portion 56 on each side of the semi-circular cut out 40 of this ridge 54 an opening 58 or 59 is formed. In the preferred embodiment on one of these two openings 58 and 59 are threaded. The openings are adapted such that a screw 60 can be placed through the non threaded opening 58 in one disk 12 and then threaded into a treated opening 59 in the other disk 14. The tightening down these screws 60 forms the cylindrical disk of the invention as in FIG. 1 and 5.

As shown in FIG. 1, 2, 3 and 4 on a straight portion 56 of the top ridge 54 on its inside edge a shoulder 44 extends outward from the ridge 54. This shoulder 44 is adapted such then the two semi-circular disks 12 and 14 are tighten together the shoulder 44 of one semi-circular disk 12 makes contact with the other semi-circular disk 14 such that the lower portions of the semi-circular disk 14 that do not have the shoulder on either disk are drawn closer and thus angling the semi-circular disks 12 and 14 causing the feet 30, 32 and 34 on the annular ridge 18 to dig into the painted surface of the can 24. This digging into the painted surface of the can 24, scratches the paint off the can 24 and allows the feet 30, 32 and 34 to make metal to metal contact with the can 24 and thus ensures that static electric which forms on the can 24 during the pumping will flow into the adapter. This could also be accomplish by putting a shoulder on each straight portion 56 on the ridge 54 on just one or both of the semi-circular disk 12 and 14.

A threaded opening 48 is placed in the ridge on the one of the semi-circular disks 12 and 14 in the area the ridge that forms the semi-circular cut out as shown in FIG. 5. A conductive sloted set screw 80 is placed through this opening and this set screw 80 can be screwed tightly against a pump 52 placed through the bore to hold the pump 52 in place as shown in FIG. 5. One could also use a hex or thumb screw.

Changes and modifications in the specifically described embodiments can be carried out without departing from the scope of the invention which is intended to be limited only by the scope of the claims.

I claim:

1. A pump clamp adapter for attaching a pump with a circumference to a receptacle container and said receptacle container has an annular rim around an opening through which the pump is placed comprising:

a. a first semi-circular disk with a top and bottom and said semi-circular disk has a circular edge and a straight edge and on the bottom of the semi-circular disk along the circular edge is a first ridge that extends downward and along the straight edge is a semi-circular cut out and along the straight edge and the semi-circular cut out is a second ridge that extends upward from the top of said semi-circular disk; and, b. a second semi-circular disk with a top and bottom and said semi-circular disk has a circular edge and a straight edge and on the bottom of the semi-circular disk along the circular edge is a first ridge that extends downward and along the straight edge is a semi-circular cut out and along the straight edge and the semi-circular cut out is a second ridge that extends upward from the top of said semi-circular disk; and, c. a means for attaching the two semi-circular disks together to form a circular disk; and, d. when the two semi-circular disks are attached together the ridge along the bottom extending downward from the circular edges and forms an annular recess on the bottom of the adapter that is of sufficient size to fit over the annular rim of the receptacle container and when the semi-circular disks are placed over the annular rim of the receptacle container and attached together the annular rim of the two circular disks makes contact with the annular rim of the receptacle container, and when the two semi-circular disks are attached together the semi-circular cut out form a boar that is larger then the circumference of the pump; and, e. a means for holding the pump in the boar in a position for pumping.

2. A pump clamp adapter as in claim 1 wherein:

a. the means for attaching the two semi-circular disks together to form a circular disk comprises:

(1) openings on the second ridge on each semi-circular disks; and, (2) screws adapted to fit within said openings; and, (3) wherein the two semi-circular disks are placed together to form a circular disk and the openings in one semi-circular disk are adapted such that they line up with the openings of the other semi-circular disks and at least one of the openings is threaded so that screws can be placed through the openings and when the screw is tighten it causes two semi-circular disks to form a circular disk.

3. A pump clamp adapter as in claim 2 wherein:

a. the means for holding the pump in the boar comprises:

(1) a threaded opening in the second ridge where the second ridge extends upward around the semi-circular cut out; and, (2) a screw adapted to the screw in and out of said opening; and, (3) the screw is placed in the opening and the pump is placed through the boar and the screw is then screwed into the opening passing through the opening and making contact with the pump to hold the pump in place.

4. A pump clamp adapter as in claim 3 further comprising:

a. a means for making electrical contact with the receptacle container.

5. A pump clamp adapter as in claim 2 further comprising:

a. a means for making electrical contact with the receptacle container.

6. A pump clamp as in claim 1 wherein:

a. the means for holding the pump in the boar comprises:

(1) a threaded opening in the second ridge where the second ridge extends upward around the semi-circular cut out; and, (2) a screw adapted to the screw in and out of said opening; and, (3) the screw is placed in the opening and the pump is placed through the boar and the screw is then screwed into the opening passing through the opening and making contact with the pump to hold the pump in place.

7. A pump clamp adapter as in claim 6 further comprising:

a. a means for making electrical contact with the receptacle container.

8. A pump clamp adapter as in claim 1 further comprising:

a. a means for making electrical contact with the receptacle container.

9. A pump clamp adapter for attaching a pump with a circumference to a receptacle container and said receptacle container has an annular rim around the opening through which the pump is placed comprising:

a. a first semi-circular disk with a top and bottom and said semi-circular disk has a circular edge and a straight edge and on the bottom of the semi-circular disk along the circular edge is a first ridge that extends downward and along the straight edge is a semi-circular cut out and along the straight edge and the semi-circular cut out is a second ridge that extends upward from the top of said semi-circular disk; and, b. a second semi-circular disk with a top and bottom and said second semi-circular disk has a circular edge and a straight edge and on the bottom of the second semi-circular disk along the circular edge is a first ridge that extends downward and along the straight edge is a semi-circular cut out and along the straight edge and the semi-circular cut out is a second ridge that extends upward from the top of said second semi-circular disk: and, c. a means for attaching the two semi-circular disks together to form a circular disk; and, d. when the two semi-circular disks are attached together the ridge along the bottom extends downward from the circular edges and forms an annular recess on the bottom of the adapter that is of sufficient size to fit over the annular rim of the receptacle container and when the semi-circular disks are placed over the annular rim of the receptacle container and attached together the first ridge of the two circular disks makes contact with the annular rim of the receptacle container, and when the two semi-circular disks are attached together the semi-circular cut out form a boar that is larger then the circumference of the pump;

e. a means for hold the pump in the boar in a position for pumping, f. a means for making electrical contact with a conductive receptacle container is a means for scratching the paint off the surface of the receptacle container underneath the adapter and said adapter making contact with said unpainted surface; and, g. the adapter is conductive.

10. A pump clamp adapter as in claim 9 wherein:

a. the means for scratching the paint off the surface of the receptacle container underneath the adapter comprises:

(1) wedge shaped feet on the bottom of the first ridge of one of the semi-circular disk; and, (2) a shoulder on the top portion of the second ridge of one of the semi-circular disk which extends outward from the second ridge; and, (3) wherein the shoulder is adapted such that when the two semi-circular disks are tighten together the shoulder on one of the semi-circular disk makes contact the other semi-circular disk such that the lower portion of the semi-circular disk that does not have the shoulder is drawn closer and thus angling the semi-circular disk causing the feet on the first ridge to scratch the painted surface on the can and said feet then make contact with the unpainted surface of the receptacle container.

11. A pump clamp adapter as in claim 9 wherein:

a. the means for scratching the paint off the surface of the receptacle container underneath the adapter comprises:

(1) wedge shape feet on the bottom of the first ridge of one of the semi-circular disk; and, (2) a shoulder on the top of the second ridge of both semi-circular disk which extends outward from the second ridge; and, (3) wherein the shoulder is adapted such that when the two semi-circular disk are tighten together the shoulder on one of the semi-circular disk makes contact with the shoulder on the other semi-circular disk such that the lower portion of the semi-circular disk that do not have shoulders are drawn closer and thus angling the semi-circular disk causing the feet on the first ridge to scratch the painted surface on the can and said feet have then made contact with non painted surface of the receptacle container.

12. A pump clamp adapter as in claim 11 wherein:

a. wedge shape feet are on both semi-circular disks.

13. A pump clamp adapter as in claim 9 wherein:

a. the means for attaching the two semi-circular disks together to form a circular disk comprises:

(1) openings on the second ridge on each semi-circular disks; and, (2) screws adapted to fit within said openings; and, (3) wherein the two semi-circular disks are placed together to form a circular disk and the openings in one semi-circular disk are adapted such that they line up with the openings of the other semi-circular disks and at least one of the openings is threaded so that screws can be placed through the openings and when the screw is tighten it causes the two semi-circular disks to form a circular disk.

14. A pump clamp adapter as in claim 13 wherein:

a. the means for scratching the paint off the surface of the receptacle container underneath the adapter comprises:

(1) wedge shaped feet on the bottom of the first ridge of one of the semi-circular disk; and, (2) a shoulder on the top portion of the second ridge of one of the semi-circular disk which extends outward from the second ridge; and, (3) wherein the shoulder is adapted such that when the two semi-circular disks are tighten together the shoulder on one of the semi-circular disk makes contact the other semi-circular disk such that the lower portion of the semi-circular disk that does not have the shoulder is drawn closer and thus angling the semi-circular disk causing the feet on the first ridge to scratch the painted surface on the can and said feet then make contact with the unpainted surface of the receptacle container.

15. A pump clamp adapter as in claim 13 wherein:

a. the means for holding the pump in the boar comprises:

(1) a threaded opening in the second ridge where the second ridge extends upward around the semi-circular cut out; and, (2) a screw adapted to be screwed in and out of said opening; and, (3) the screw is placed in the opening and the pump is placed through the boar and the screw is then screwed into the opening passing through the opening and making contact with the pump to hold the pump in place.

16. A pump clamp adapter as in claim 15 wherein:

a. the means for scratching the paint off the surface of the receptacle container underneath the adapter comprises:

(1) wedge shaped feet on the bottom of the first ridge of one of the semi-circular disk; and, (2) a shoulder on the top portion of the second ridge of one of the semi-circular disk which extends outward from the second ridge; and, (3) wherein the shoulder is adapted such that when the two semi-circular disks are tighten together the shoulder on one of the semi-circular disk makes contact the other semi-circular disk such that the lower portion of the semi-circular disk that does not have the shoulder is drawn closer and thus angling the semi-circular disk causing the feet on the first ridge to scratch the painted surface on the can and said feet then make contact with the unpainted surface of the receptacle container.

17. A pump clamp as in claim 9 wherein:

a. the means for holding the pump in the boar comprises:

(1) a threaded opening in the second ridge where the second ridge extends upward around the semi-circular cut out; and, (2) a screw adapted to be screwed in and out of said opening; and, (3) the screw is placed in the opening and the pump is placed through the boar and the screw is then screwed into the opening passing through the opening and making contact with the pump to hold the pump in place.

18. A pump clamp adapter as in claims 13 wherein:

a. the means for scratching the paint off the surface of the receptacle container underneath the adapter comprises:

(1) wedge shaped feet on the bottom of the first ridge of one of the semi-circular disk; and, (2) a shoulder on the top portion of the second ridge of one of the semi-circular disk which extends outward from the second ridge; and, (3) wherein the shoulder is adapted such that when the two semi-circular disks are tighten together the shoulder on one of the semi-circular disk makes contact the other semi-circular disk such that the lower portion of the semi-circular disk that does not have the shoulder is drawn closer and thus angling the semi-circular disk causing the feet on the first ridge to scratch the painted surface on the can and said feet then make contact with the unpainted surface of the receptacle container.

* * * * *